US008299888B2

(12) United States Patent
Koyama

(10) Patent No.: US 8,299,888 B2
(45) Date of Patent: Oct. 30, 2012

(54) PTC DEVICE AND PROCESS FOR MANUFACTURING THE SAME

(75) Inventor: Hiroyuki Koyama, Narita (JP)

(73) Assignee: Tyco Electronics Japan G.K., Kawasaki (JP)

( * ) Notice: Subject to any disclaimer, the term of this patent is extended or adjusted under 35 U.S.C. 154(b) by 267 days.

(21) Appl. No.: 12/733,148

(22) PCT Filed: Aug. 8, 2008

(86) PCT No.: PCT/JP2008/064322

§ 371 (c)(1),
(2), (4) Date: Apr. 26, 2010

(87) PCT Pub. No.: WO2009/022655

PCT Pub. Date: Feb. 19, 2009

(65) Prior Publication Data

US 2010/0237981 A1 Sep. 23, 2010

(30) Foreign Application Priority Data

Aug. 14, 2007 (JP) ..... 2007-211343

(51) Int. Cl.
*H01C 7/10* (2006.01)

(52) U.S. Cl. ..... 338/22 R; 338/328; 29/610.1; 252/510

(58) Field of Classification Search ..... 338/22 R, 338/25, 328, 332; 29/610.1, 611, 612; 428/209, 428/901; 252/510, 511
See application file for complete search history.

(56) References Cited

U.S. PATENT DOCUMENTS

| | | | | |
|---|---|---|---|---|
| 4,426,633 | A * | 1/1984 | Taylor | 338/25 |
| 5,303,115 | A * | 4/1994 | Nayar et al. | 361/106 |
| 6,396,384 | B1 * | 5/2002 | Blok et al. | 338/22 R |
| 7,352,272 | B2 * | 4/2008 | Wang et al. | 338/22 R |
| 7,391,295 | B2 * | 6/2008 | Wang et al. | 338/22 R |

FOREIGN PATENT DOCUMENTS

| | | | |
|---|---|---|---|
| JP | 58-66602 | U | 5/1983 |
| JP | 62-69697 | A | 3/1987 |
| JP | 63-95652 | A | 4/1988 |
| JP | 3-76388 | U | 7/1991 |
| WO | WO-97/06538 | A1 | 2/1997 |
| WO | WO-2007/052790 | A1 | 5/2007 |

OTHER PUBLICATIONS

International Search report for International Application No. PCT/JP2008/064322 mailed Nov. 11, 2008.

* cited by examiner

*Primary Examiner* — Kyung Lee

(57) ABSTRACT

There are provided a process for manufacturing a PTC device as well as a PTC device manufactured by such process wherein a resin coating for preventing the oxidation can be easily formed. The PTC device includes (A) a polymer PTC component (14) comprising: (a1) an electrically conductive filler, and (a2) a polymer material wherein the polymer PTC component is defined by opposite main surfaces and a side surface connecting outer peripheries of these main surfaces, and (B) layered metal electrodes (12, 22) placed on the main surfaces on both sides of the polymer PTC component. The PTC device has a support member (20) extending outward from a periphery of at least one of the main surfaces, and the side surface of the polymer PTC component is sealed from an ambient environment around the PTC device by a cured curable resin (24) disposed and supported on the support member.

12 Claims, 4 Drawing Sheets

PTC DEVICE AND PROCESS FOR MANUFACTURING THE SAME

FIELD OF THE INVENTION

The present invention relates to a PTC device and a process for the manufacture of the same. In more detail, it relates to a PTC device using a polymer PTC component which contains a metal filler as an electrically conductive filler, in particular a filler susceptible to oxidation under an oxygen atmosphere, and a process for the manufacture of the same.

INTRODUCTION TO THE INVENTION

In various electrical or electronic equipments, when an excessively large electrical current flows through a power supply circuit and the like, a polymer PTC (Positive Temperature Coefficient) device is widely used in order to prevent an important component constituting such an equipment from breaking down in advance. Such a device per se is well-known, and it usually comprises a PTC component and metal foil electrodes disposed on opposite main surfaces thereof wherein the PTC component is generally in the form of a layer and made of a polymer composition in which the conductive filler is dispersed in a polymer.

For example, a PTC device used for a power circuit or a chargeable battery pack including a dry battery has a disc-shaped form having in its center a through hole capable of housing a positive electrode projection of the dry battery. When using the device, surrounding the positive electrode projection of the dry battery with the through hole of the PTC device, and disposing the PTC device so that one metal foil electrode of the PTC device is in contact with a sealing plate of the dry battery. Then, a predetermined lead for example is connected to the other metal foil electrode.

As one requirement to be fulfilled by such a PTC device, it is required that the PTC device have a low resistance under a normal condition. For a PTC component used for such a low-resistance PTC device, a metal filler, in particular a nickel or nickel alloy filler is used as the electrically conductive filler dispersed in a polymer. Such metal filler is likely to be oxidized by oxygen present in an ambient atmosphere around the PTC device. As a result, a resistance of the PTC component increases. Such an increase in resistance is not preferred for the PTC device which should essentially have a low resistance.

Therefore, in the PTC device using such a metal filler, measures of forming a resin coating for covering an exposed portion of the PTC component are adopted in order for the exposed portion not to be in contact with the ambient atmosphere, accordingly, in order to prevent the oxidation of the metal filler. Since the main surfaces of the PTC component are covered with the metal foil electrodes as described above, such an exposed portion is exclusively a side surface portion of the PTC component (namely, a side surface portion defining a thickness of the laminar PTC component, and therefore a surface connecting peripheries of the opposite main surfaces of the PTC component).

Forming the resin coating is performed by, after preparing a PTC device which comprises a PTC component, and on its main surfaces, metal foil electrodes having the same shape as the main surfaces, applying a curable resin to the side surface portion of the PTC component, and curing the applied resin thereafter. The application of the curable resin can be performed by applying the resin with a brush, spraying or the like. Since the cured resin is generally electrically insulating, a great deal of care needs to be taken during this application, so that the resin is not supplied onto the exposed surfaces of the metal foil electrodes due to contact of the brush with the metal foil electrodes. Therefore, such application is not easy.

Patent Document 1: International Publication WO1997/06538

SUMMARY OF THE INVENTION

Therefore, the problem to be solved by the invention is to provide a process for manufacturing a PTC device capable of easily forming a resin coating for the prevention of the oxidation, and also to provide a PTC device manufactured by such a process.

The present inventor intensively studied the above problem. As a result, the present inventor has found that, by providing a support member protruding outward from a main surface of the PTC component and supplying a curable resin on the support member, the supplied resin easily wets and spreads on the side surface of the PTC component, and consequently, substantially the entirety of the exposed side surface of the PTC component is covered with the resin, thus completing the present invention. Although this support member may protrude from only one main surface of the PTC element, it is particularly preferred that it protrudes from each of the main surfaces. In the case of the former, the curable resin supplied onto the support member wets the side surface of the PTC component by a meniscus force or a capillary force, and spreads over the substantial entirety of the side surface. Further, in the case of the latter, the curable resin supplied on one support member or the curable resin supplied between both the support members spreads over the substantial entirety of the side surface of the PTC component.

In each case, as a result of the spread of the supplied curable resin, the curable resin is present not only on the side surface of the PTC component. In addition to that, it is present on at least a portion of an inside surface (namely, a surface closer to the side surface of the PTC component) of one or both (i.e. an embodiment wherein the support member protrudes from each of the main surfaces) of the support members, which portion is adjacent to the side surface of the PTC component. In this sense, in the present invention, even if the support members protrude from both the main surfaces, "the curable resin is supplied on the support member(s)", and therefore when the resin is hardened, "the hardened resin is disposed and supported on the support member(s)".

As described above, by curing the curable resin which spreads over the entirety of the side surface, the side surface of the PTC component is sealed against the ambient atmosphere. Therefore, it is possible to form a resin coating that inhibits access of oxygen present in the ambient atmosphere to the electrically conductive filler dispersed in the PTC component (strictly speaking, in the polymer which constitutes the PTC component) as much as possible.

Accordingly, in a first aspect, the present invention provides a PTC device, comprising:

(A) a polymer PTC component comprising:
  (a1) an electrically conductive filler, and
  (a2) a polymer material;
  the polymer PTC component being defined by opposite main surfaces and a side surface connecting outer peripheries of these main surfaces, and (B) layered metal electrodes placed on the main surfaces on both sides of the polymer PTC component, wherein the PTC device comprises a support member extending outward from a periphery of at least one of the main surfaces of the polymer PTC component, and the side surface of the polymer PTC component is sealed from an ambient environment around the PTC device by a cured curable resin disposed and supported on the support member.

In a second aspect, the present invention provides a process for the manufacture of a PTC device, the PTC device comprising:

(A) a polymer PTC component comprising:

(a1) an electrically conductive filler, and (a2) a polymer material;

the polymer PTC component being defined by opposite main surfaces and a side surface connecting outer peripheries of these main surfaces, and (B) layered metal electrodes placed on main surfaces on both sides of the polymer PTC component, the process comprising:

a resin supplying step of supplying a curable resin onto a support member extending outward from a periphery of at least one of the main surfaces of the polymer PTC component so as to cover the side surface of the polymer PTC component; and a step of curing the curable resin.

In addition, the present invention also provides an electronic or electrical equipment (for example, a battery pack, a Ta capacitor and the like) having, as a circuit protection element, the PTC device of the first aspect or the PTC device manufactured by the process for the manufacture of the second aspect.

In the present invention, when the support member is provided, onto which the curable resin is supplied, and preferably, the curable resin is supplied onto a point of the support member which is preferably close to the PTC component as much as possible, the curable resin spreads over the inside surface of the support member, and also easily spreads so as to cover the entirety of the side surface of the PTC component. However, it is difficult, and substantially impossible for the curable resin to spread onto the surface of the exposed layered metal electrode(s) of the PTC device. By curing the resin spread in such a manner, a resin coating which functions as a seal is formed. Therefore, the formation of the resin coating that suppresses the oxygen access becomes simple and more sufficient.

EXPLANATION OF THE REFERENCES

Figure 1:
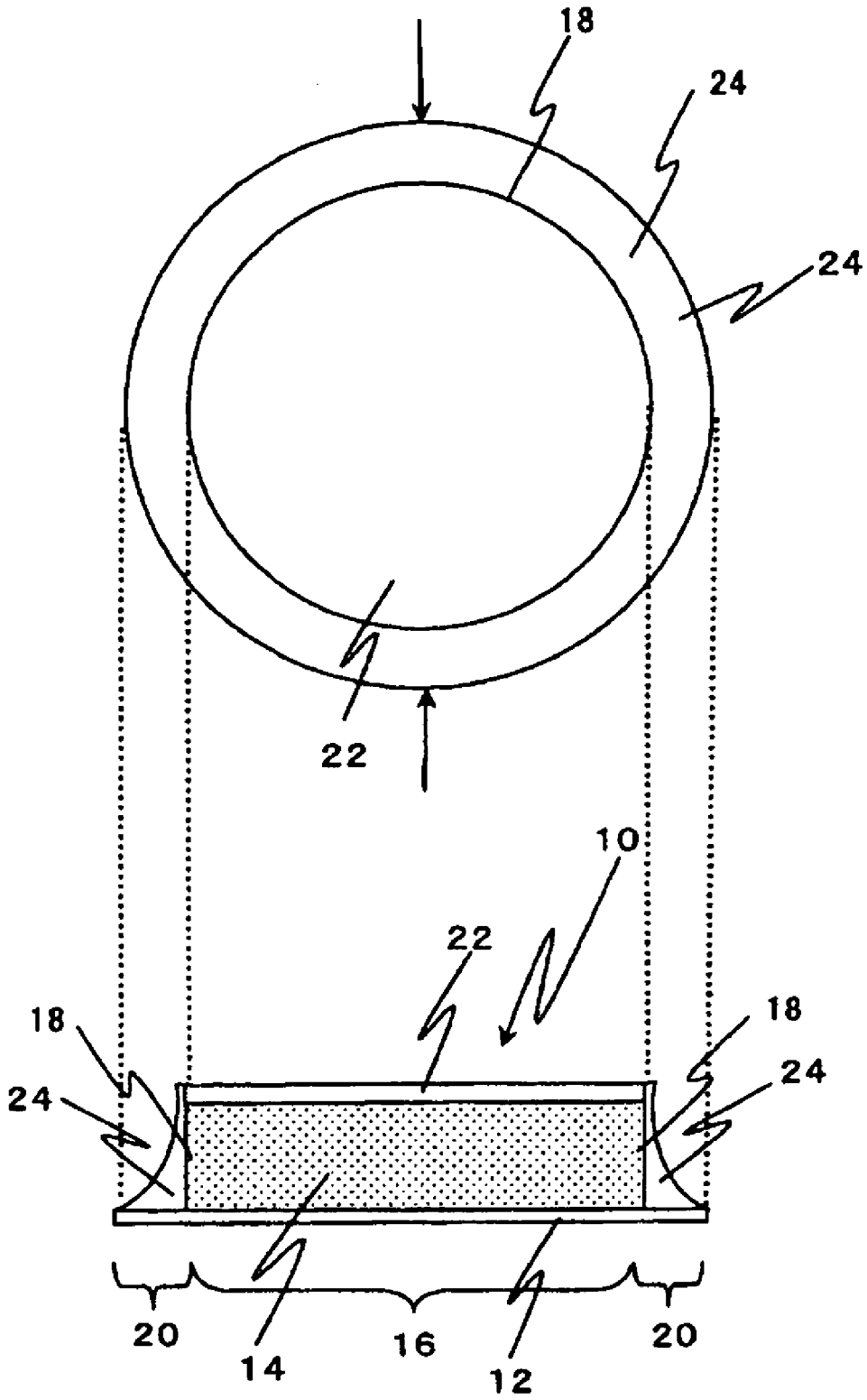
FIG. 1 schematically shows a top view and a side view of one embodiment of a PTC device according to the present invention.

10 . . . PTC device
12 . . . layered metal electrode
14 . . . PTC component
16, 16' . . . first part
18 . . . side surface of PTC component
20, 20' . . . second part
22 . . . layered metal electrode
24 . . . resin coating
28 . . . peripheral part
52 . . . plastic film member
54 . . . inner portion
56 . . . rim-like portion
58 . . . adhesive layer

DETAILED DESCRIPTION OF THE INVENTION

Next, the present invention will be described with reference to the drawings. It is noted that the PTC device, materials used for various components which constitute the PTC device (e.g., the PTC component, the electrically conductive filler, the polymer material, the layered metal electrodes (e.g., metal foil electrodes), the curable resin and the like), and a process for the manufacture of the PTC device per se are well-known. Such what are well-known can be used also in the present invention. Accordingly, in the present specification, what are characteristic of the present invention (in particular a support member and matters related thereto) will be mainly described in detail.

One embodiment of the PTC device according to the present invention is schematically shown in FIG. 1 wherein a top view of the PTC device is shown in the upper portion of FIG. 1, and a side view of the PTC device is shown in the lower portion of FIG. 1. In the illustrated embodiment, one layered metal electrode 12 of the PTC device 10 is constructed of a first part 16 positioned on a main surface of a PTC component 14, and a second part 20 extending outward from a side surface 18 of the PTC component 14. In the illustrated embodiment, the second part 20 protrudes outward from the side surface 18 of the PTC component 14 over the entire periphery of the first part 16. The second part 20 functions as a support member which extends outward from the periphery of one main surface of the PTC component 14 (a lower main surface of the PTC component 14 in the illustrated embodiment). As clearly seen, the first part 16 has the same shape and the same size as those of the main surfaces of the PTC component 14, and the second part 20 is a portion which protrudes outward from the main surface of the PTC component 14. It is noted that an outer profile of the support member is circular in the illustrated embodiment. However, it is not necessarily circular, and may be of any shape as long as it can support the curable resin. For example, the outer profile may be a square, a polygon or the like.

When the curable resin is supplied onto the second part 20 which functions as the support member, the supplied resin 24 spreads over the entire periphery of the PTC component 14, and also wets up the side surface of the PTC component 14 due to wettability and adhesion of the curable resin with respect to the side surface 18 of the PTC component 14, preferably wettability and adhesion of the curable resin with respect to the side surface 18 of the PTC component 14 as well as a side surface of a layered metal electrode 22. It is a matter of course that the supplied resin 24 also spreads onto an inside surface of the second part 20 (namely, an upper side surface of the second part) due to the wettability and the adhesion of the curable resin with respect to the inside surface. As a result, the supplied curable resin becomes of a meniscus shape as shown in the drawing. By curing such resin, a resin coating 24 can be formed as a sealing part for covering the side surface 18 of the PTC component 14. In the embodiment shown in FIG. 1, the layered metal electrode 22 is positioned on an upper main surface of the PTC component 14, and such upper surface is in an exposed state. However, it is not easy at all for the curable resin supplied to the support member to reach the exposed upper main surface.

In one preferred embodiment, the PTC component 14 has a flat disc shape (circular plate shape) as shown in the figure. Therefore, one layered metal electrode 22 substantially covers the entirety of one circular main surface of the disc, and the other layered metal electrode 12 further has the second part 20 which protrudes by equal distances from the periphery (namely, an edge) of the other circular main surface of the disc. It is noted that the second part 20 preferably protrudes by the equal distances, but it is not necessarily required. Therefore, a diameter of the layered metal electrode 12 is larger than a diameter of the metal electrode 22 by the protruding distances. As described above, in the case where one layered metal electrode of the PTC device serves as the support member, the support member (namely, the second part) protrudes from the side surface 18 of the PTC component 14 by a distance corresponding to preferably at least 0.5 times, more preferably at least one time, and particularly preferably at least 1.5 times, for example at least two times a thickness of the PTC component. Also in an embodiment which will be described below with reference to FIG. 4, it is preferred that the protruding length of the rim-like portion is the same as in this embodiment.

It is noted that although the curable resin may be supplied onto only one point on the periphery of the PTC component 14, it is preferably supplied to a plurality of points on the periphery of the PTC component 14. For example, the curable resin is supplied onto points which are symmetrically located when seeing the main surface of the PTC component from its above. For example, in the illustrated embodiment, the curable resin is supplied onto two points along a diameter direction as shown in the arrows. In a further embodiment, the curable resin may be supplied at equal angles (for example two points at every 180° (the illustrated embodiment), four points at every 90°, or six points at every)60° around the center of the PTC component. In a still further embodiment, the resin may be supplied while rotating a resin supply port relatively around the PTC component 14.

Figure 2:
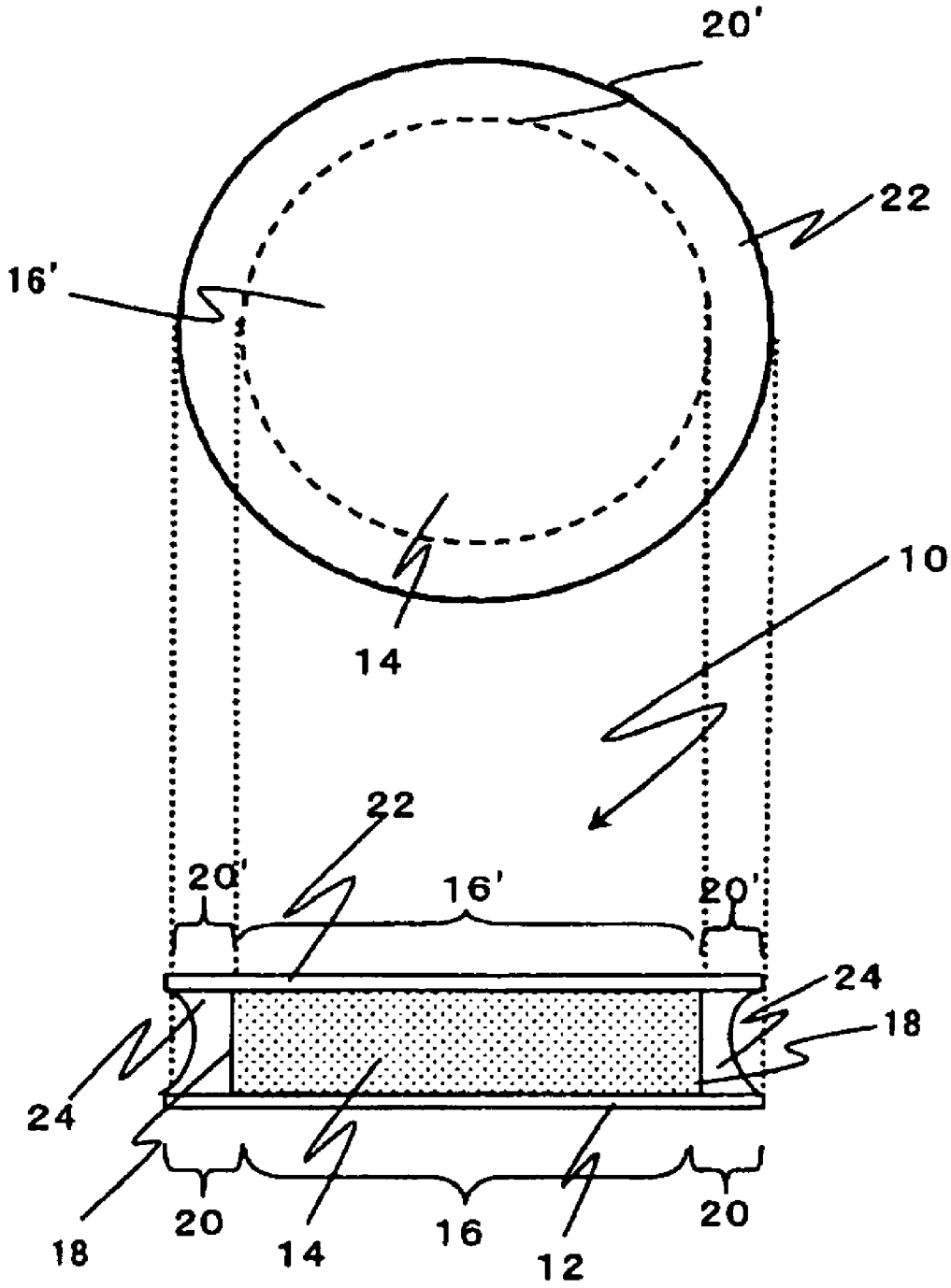
FIG. 2 schematically shows a top view and a side view of another embodiment of the PTC device according to the present invention.

Other embodiment of the PTC device of the present invention is schematically shown in FIG. 2 in the same manner as in FIG. 1. The embodiment shown in FIG. 2 is different from the embodiment shown in FIG. 1 in that the layered metal electrode 22 disposed on the upper main surface of the PTC component 14 also has a second part 20' like the layered metal electrode 12. Therefore, the layered metal electrode 22 is constructed of a first part 16' and the second part 20'. That is, the second parts 20 and 20' are positioned as the support members at the peripheries of both the main surfaces of the PTC component 14.

As a result, the curable resin supplied onto the second part 20 wets and spreads, around the PTC component 14, along the side surface 18 of the PTC component 14 and inside surfaces of the layered metal electrodes 12 and 22 (namely, opposite inside surfaces of the second parts 20 and 20') due to the wettability and the adhesion to the side surface 18 of the PTC component 14 as well as to the inside surfaces of the layered metal electrodes 12 and 22. The supplied resin becomes of a meniscus shape as shown in FIG. 2. After that, the resin is cured by an appropriate method depending on the curable resin so as to form a resin coating 24. It is noted that in the illustrated embodiment, the curable resin may be supplied to the side surface 18 of the PTC component 14, and specifically it may be supplied so as to be in contact with the side surface 18. In this case also, the supplied resin spreads over the entirety of the side surface 18 and at least a portion (a portion connected with the side surface 18) of the opposite inside surfaces of the second parts 20 and 20' as the support members.

It is noted that the curable resin becomes of a similar meniscus shape also in the case where it is supplied on the second part 20' present on the other main surface of the PTC component 14. In fact, by supplying the curable resin between the second part 20 and the second part 20', the supplied resin spreads on the side surface of the PTC component 14 and the inside surfaces of the second parts of both the layered metal electrodes, and becomes of a state shown in the drawing. As described above, in the case where both the layered metal electrodes provide with the support members, the support members (namely, the second parts) protrude from the side surface of the PTC component 14 by a distance corresponding to preferably at least 0.3 times, more preferably at least one time, and particularly preferably at least 1.5 times, for example at least two times the thickness of the PTC component. Also in an embodiment which will be described below with reference to FIG. 3, it is preferred that the protruding length of the rim-like portion therein is the same as in this embodiment.

Figure 3:
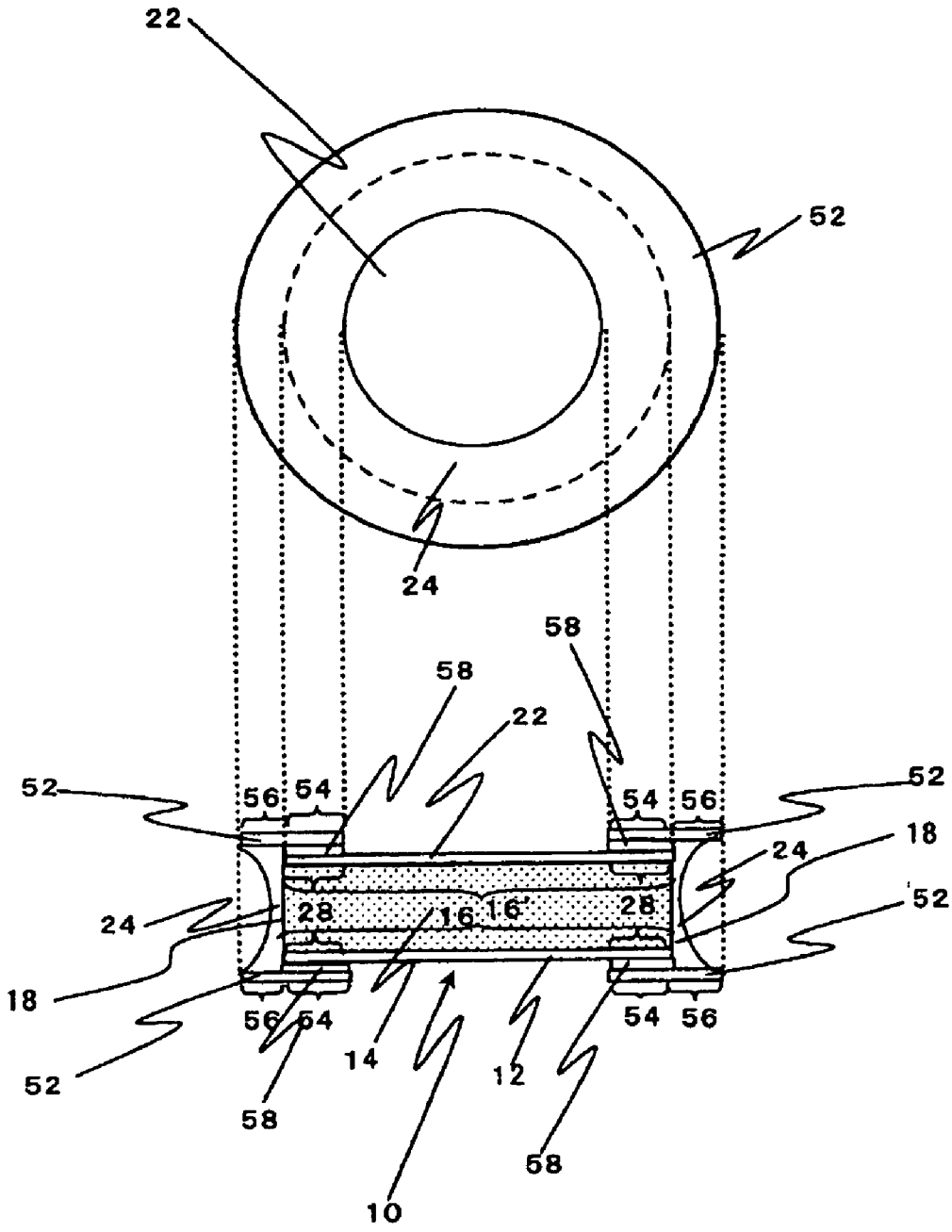
FIG. 3 schematically shows a top view and a side view of a further embodiment of the PTC device according to the present invention.

A further embodiment of the PTC device according to the present invention is schematically shown in FIG. 3 in the same manner as in FIG. 1. In the embodiment shown in FIG. 3, the layered metal electrodes 12 and 22 (corresponding to the above described first parts 16 and 16') that extend only on the both sides of the main surfaces (namely, the opposite main surfaces) of the PTC component 14 are present, and the layered metal electrodes per se have no support member as a portion extending outward from the side surface 18 of the PTC component 14. In this manner, the PTC element is constructed of the PTC component 14 and the layered metal electrodes disposed on the opposite main surfaces thereof.

In place of that, plastic film members 52 are present on the layered metal electrodes 12 and 22 as separate members. These plastic film members 52 are constructed of inner portions 54 positioned on peripheral parts 28 of the layered metal electrodes 12 and 22 (portions of the plastic film members) and rim-like portions 56 extending outward from peripheries of the inner portions 54, and each of rim-like portions 56 serves as the support member. The layered metal electrode 12 or 22 and the plastic film member 52 is bonded by an adhesive layer 58 positioned between them. Any appropriate adhesive or any appropriate method may be used for forming the adhesive layer 58. For example, it can be formed by thermally curing the epoxy-based resin used as the adhesive layer. In this case, the inner portions 54 of the plastic film members 52 are positioned "above" the peripheral parts 28 of the layered metal electrodes 12 and 22 related to the meaning in that the adhesive layers 58 intervene. It is noted that the peripheral parts 28 correspond to a flat annular portions extending inward from the peripheries of the layered metal electrodes 12 and 22, and openings are formed inside the inner portions 54 of the plastic film members 52, where the layered metal electrodes are exposed so that they can be connected to predetermined electrical components (for example, an electrode of a battery, a lead and the like).

In other embodiment, in the case where the plastic film member 52 has a bonding property (or an adhesion property) to the layered metal electrode, or can be thermocompression bonded, the adhesive layer 58 is not required to be present. In such meaning, the plastic film member 52 is positioned "on" the peripheral part 28 of the layered metal electrode 12 or 22.

With the device of the illustrated embodiment, a PTC device having the layered metal electrodes 12 and 22 which have the same size as the main surfaces on both the sides of the PTC polymer component 14 (therefore, the metal electrodes having only the first parts 16 and 16') is prepared in advance. The adhesive layers 58 are formed on the peripheral parts 28 of the layered metal electrodes, and the plastic film members 52 are disposed thereon, so that the rim-like portions 56 are protruded from the side surface 18 of the PTC component 14.

Thereafter, when the curable resin is supplied between the opposite rim-like portions 56, and the distance between the rim-like portions is sufficiently small, the curable resin supplied over the entire periphery of the PTC component 14 wets and spreads, due to the capillary action, on the side surface 18 of the PTC component, and technically on side surfaces of the adhesive layers 58, and also on the rim-like portions 56 as the support members so as to substantially cover the entirety of the side surface of the PTC component. After that, by curing the curable resin, the PTC component is sufficiently isolated from the periphery to prevent the oxidation of the electrically conductive filler contained in the PTC component.

Figure 4:
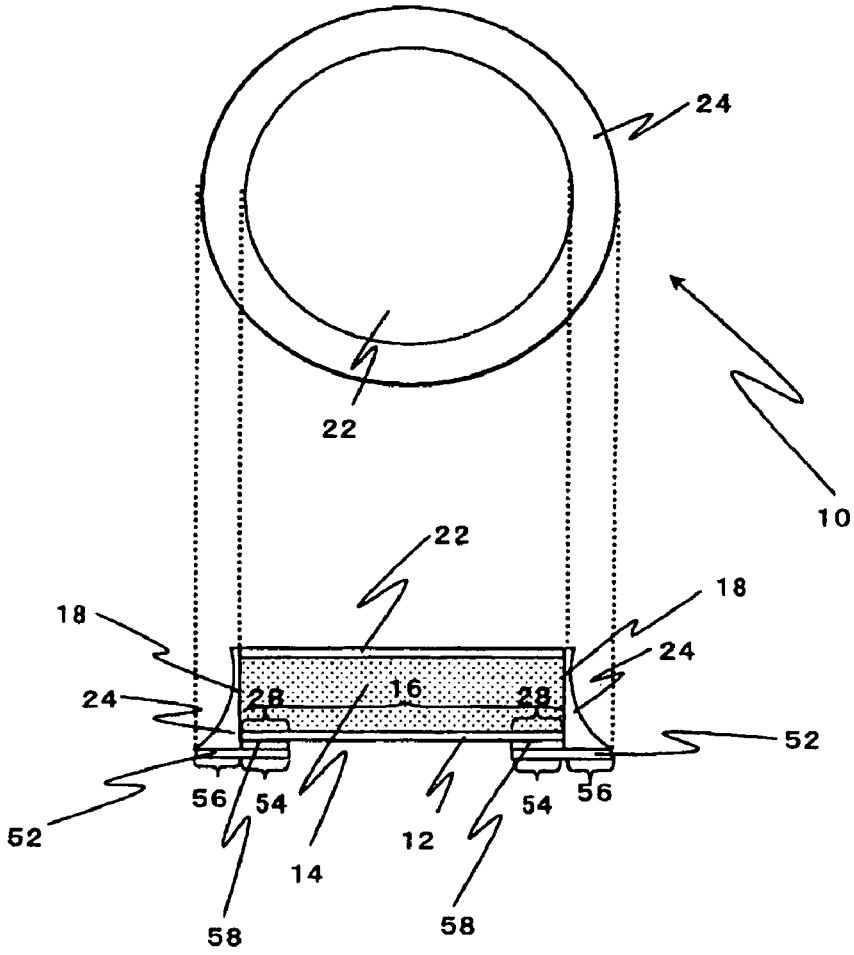
FIG. 4 schematically shows a top view and a side view of a still further embodiment of the PTC device according to the present invention.

A still further embodiment of the PTC device according to the present invention is schematically shown in FIG. 4 in the same manner as in FIG. 1. In the embodiment shown in FIG. 4, similarly to FIG. 3, the layered metal electrodes 12 and 22 (corresponding to the above described first parts 16 and 16') are present only on both the main surfaces of the PTC component 14, and the layered metal electrodes have no support member as the portion extending outward from the side surface 18 of the PTC component 14. The plastic film member 52 is disposed below only a lower layered metal electrode 12 through the adhesive layer 58. The other configurations are substantially the same as those in the embodiment of FIG. 3.

In the illustrated embodiment, when the curable resin is supplied on the rim-like portion 56 of the plastic film member 52 as described with reference to FIG. 1, the curable resin wets and spreads around the periphery of the PTC component 14, and also wets and spreads on the side surfaces of the PTC component 14 and the layered metal electrode 22. After that, by curing the resin, the side surface 18 of the PTC component 14 can be sealed by the cured resin coating 24.

The curable resin for forming the oxidation preventive resin coating used in the PTC device according to the present invention may be any well-known liquid resin, which is known to be used for such a purpose in the PTC device. It is noted that the liquid resin means a resin which can spread at least on the side surface of the PTC component by the capillary force or meniscus force when the resin is supplied as described above. For example, the curable resin such as an epoxy-based resin or the like can be used. When the curable resin is not originally in a liquid state, the curable resin is preferably in a liquid form wherein the resin is diluted or dispersed with a solvent. The curable resin may optionally contain other additives (for example, a curing agent, a curing accelerator and the like). Curing of the curable resin may be performed by any appropriate method according to its kind, and for example, it may be performed by an ultraviolet ray, an electron beam, heating or the like.

The plastic film for forming the plastic film member 52 used in the PTC device according to the present invention may be any appropriate film made of a plastic material. For example, a polyolefin resin (a polyethylene, a polypropylene and the like), a polyester resin (a polyethylene terephthalate, a polymethylene terephthalate and the like), LCP (liquid crystal polymer) and the like can be given as examples.

Although the shape of the plastic film member 52 is not particularly limited as long as the plastic film member 52 is positioned on the peripheral part 28 of the layered metal electrode of the PTC component and it extends outward from the side surface 18 of the PTC component 14, the central portion thereof is required to have an opening through which the metal electrode of the PTC device is exposed (usually, the opening is preferably as large as possible). For example, in the case where the PTC component 14 has a disc shape as shown in the drawing, it is preferred that the plastic film member has a flat annular shape shown in for example FIG. 3, having an outer periphery which has a larger diameter than a circle defining the periphery of the main surface of the PTC component and which is concentric with such circle as well as an inner periphery which has a smaller diameter than the circle defining the periphery of the main surface of the PTC component and which is concentric with such circle. A thickness of the plastic film member may be any thickness as long as it can support the curable resin.

The manufacture of the PTC device as described above can be performed by the manufacturing process comprising: a resin supplying step of preparing the PTC device having the support member and supplying the curable resin on the support member; and then a curing step of curing the curable resin.

The resin supplying step may be performed in any appropriate manner. For example, the liquid resin can be supplied on the support member using a syringe or a dispenser having an discharge opening having a diameter having a half of the thickness of the PTC component. As described above, it is preferred that the curable resin is supplied to one point or a plurality of points (for example, two points, three points, four points, six points) on the support member, which are close to the side surface of the PTC component.

In the case where the two support members are present opposite to each other, the curable resin may be supplied onto the side surface of the PTC component positioned between them, or onto one support member (in more detail, its inside surface), or on both of the support members (in more detail, their inside surfaces). It is a matter of course that the curable resin may be supplied on at least one of the support members as well as the side surface of the PTC component. Since the liquid curable resin wets and spreads on the periphery of the PTC component between the two support members in any supplying manner, such a supply corresponds onto supply of the curable resin on the support members.

In the case where the two support members are present opposite to each other, since there is very little possibility that the resin supplied between them moves to the outside surfaces of the support members across the edges of the support members, covering of the exposed surfaces of the layered metal electrodes of the PTC device by the curable resin can be greatly inhibited. Also, even in the case where only one support member is present, it is not easy for the curable resin supplied onto the support member to wet up the side surface of the PTC component and move to the exposed surface of the layered metal electrode, and it is not easy for such supplied curable resin to move to the outside surface of the support member across the edge of the support member. Therefore, by providing the support member, a decrease in an effective area of the layered metal electrode, which should originally be functioned as the electrode, due to the curable resin is greatly inhibited. In other words, it is possible to appropriately supply the curable resin without taking a great care, compared with the case where a coating is formed on the PTC device based on the prior art technique.

The above described present invention is particularly effective in the case where the electrically conductive filler dispersed in the PTC component is a metal filler, in particular a copper filler, a nickel filler or a nickel alloy filler or the like. The reason therefor is because such a metal filler has a property that it is susceptible to the oxidation though it is effective for reducing the resistance of the PTC device, and that the resistance of the filler increases when it is oxidized. As the nickel alloy filler, a nickel-cobalt alloy filler can be exemplified.

Figure 5:
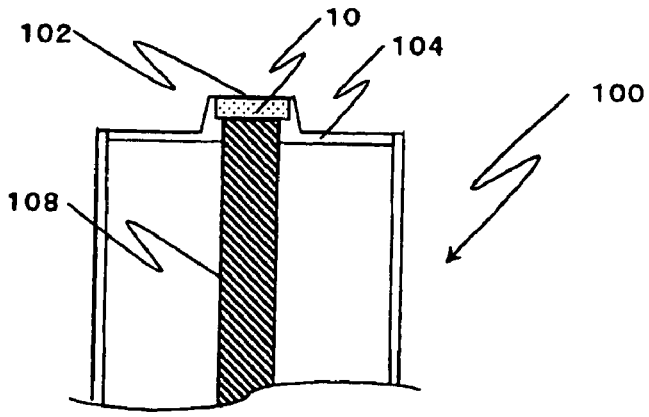
FIG. 5 schematically shows a dry battery in a schematic cross sectional view which has the PTC device according to the present invention incorporated therein.

The PTC device of the present invention can be disposed in series with a power supply circuit, so that it can be used as a circuit protection element. As one example of a particularly preferred embodiment, a cross sectional view of a dry battery having the PTC device of the present invention incorporated therein is schematically shown in FIG. 5. As shown in FIG. 5, a PTC device 10 is disposed between a metal sealing plate 104 defining a positive electrode 102 of a dry battery 100 and a carbon rod 108, and these are electrically connected.

EXAMPLE 1

A PTC device of the present invention shown FIG. 3 was manufactured using a disc-shaped PTC element (an element constructed of a PTC component 14 and electrodes (12 and 22) on both sides thereof as shown in FIG. 3, produced by Tyco Electronics Raychem K.K., diameter: 3.45 mm, thickness of the PTC component (polyethylene resin+Ni filler) 14: 0.5 mm). Flat annular plastic members 52 (made of PET, outer diameter: 5 mm, inner diameter: 2 mm, thickness: 0.1 mm) were disposed on both the metal electrodes (nickel foils) 12 and 22 by thermocompression bonding so as to partly overlap with their peripheral parts 28 of the metal electrodes.

After that, a liquid epoxy-based resin containing a curing agent was supplied as a curable resin with a dispenser to one point between opposite support members, which protruded about 0.8 mm from a side surface of the PTC component 14. The resin spread to the entirety of the side surface of the PTC component 14. Then, a resin coating for prevention of the oxidation was formed by thermosetting the resin, and thereby the PTC device of the present invention was produced. Further, a PTC device formed without a resin coating was manufactured for comparison.

These PTC devices were subjected to the accelerated oxidation test (40 atms, 7 days). Resistances before the accelerated oxidation test, i.e., the initial resistances, resistances after the accelerated oxidation test, i.e., the resistance after test, and resistances after the acceleration oxidation test and the trip, i.e., the resistance after trip were measured. It is noted that the trip conditions were 6V/50A/five minute keeping. The resistance after trip was measured one hour after the trip. The measurement results are shown in the following Table 1 and Table 2.

TABLE 1

| Without resin coating for prevention of oxidation | | | |
|---|---|---|---|
| Test Device No. | Initial Resistance | Resistance After Test | Resistance After Trip |
| 1 | 3.8 | 4.7 | 31.9 |
| 2 | 3.8 | 5.2 | 28.7 |
| 3 | 4.2 | 5.5 | 31.1 |
| 4 | 3.5 | 3.7 | 27.1 |
| 5 | 3.6 | 5.3 | 28.7 |
| Average | 3.8 | 4.9 | 29.5 |
| Minimum | 3.5 | 3.7 | 27.1 |
| Maximum | 4.2 | 5.5 | 31.9 |
| Standard Deviation | 0.2 | 0.6 | 1.8 |

TABLE 2

| With resin coating for prevention of oxidation | | | |
|---|---|---|---|
| Test Device No. | Initial Resistance | Resistance After Test | Resistance After Trip |
| 1 | 3.5 | 4.8 | 10.1 |
| 2 | 3.5 | 4.0 | 9.2 |
| 3 | 3.7 | 4.3 | 9.6 |
| 4 | 3.5 | 4.2 | 8.0 |
| 5 | 4.0 | 4.7 | 9.5 |
| Average | 3.6 | 4.4 | 9.3 |
| Minimum | 3.5 | 4.0 | 8.0 |
| Maximum | 4.0 | 4.8 | 10.1 |
| Standard Deviation | 0.2 | 0.3 | 0.7 |

As is clear from the above measurement results, with the process for the manufacture of the PTC device according to the present invention, it is possible to form the resin coating easily, and the formed resin coating proves to fulfill its function sufficiently. In more detail, with the PTC device of the present invention, the resistance after trip is obviously smaller compared with the device having no coating, which means that the oxidation of the nickel filler in the PTC component is sufficiently inhibited.

According to the present invention, a PTC device having a low resistance can be easily manufactured.

What is claimed is:

1. A PTC device, comprising (A) a polymer PTC component comprising:

(a1) an electrically conductive filler, and (a2) a polymer material;

the polymer PTC component being defined by opposite main surfaces and a side surface connecting outer peripheries of these main surfaces, and (B) layered metal electrodes placed on the main surfaces on both sides of the polymer PTC component, the PTC device having a support member extending outward from a periphery of at least one of the main surfaces, and the side surface of the polymer PTC component being sealed from an ambient environment around the PTC device by a cured curable resin disposed and supported on the support member, at least one of the layered metal electrodes having only a first part positioned on the main surface of polymer PTC component, and a peripheral part of the first part having a plastic film member on it or above it, the plastic film member comprising an inner portion positioned on or above the peripheral part of the layered metal electrode and a rim-like portion extending outward from an outer periphery of the inner portion, and the rim-like portion of the plastic film member functioning as the support member.

2. The PTC device according to claim 1, wherein the electrically conductive filler is a nickel or nickel alloy filler.

3. The PTC device according to claim 1, wherein the resin disposed on the support member is a thermosetting resin.

4. The PTC device according to claim 1, wherein both of the layered metal electrodes have only the first parts, the peripheral part of each first part has the plastic film member on it or above it, each plastic film member comprises the inner portion positioned on or above the peripheral part of the layered metal electrode and the rim-like portion extending outward from the outer periphery of the inner portion, the rim-like portion of each plastic film member functions as the support member, and the side surface of the polymer PTC component is sealed by the resin supported in a state of being sandwiched between the rim-like portions.

5. The PTC device according to claim 1, wherein the plastic film member is located by an adhesive layer disposed on the peripheral part of the layered metal electrode.

6. The PTC device according to claim 1, wherein the polymer PTC component has a flat disc shape.

7. A process for manufacturing a PTC device, the PTC device comprising:

(A) a polymer PTC component comprising:

(a1) an electrically conductive filler, and (a2) a polymer material;

the polymer PTC component being defined by opposite main surfaces and a side surface connecting outer peripheries of these main surfaces, and (B) layered metal electrodes placed on main surfaces on both sides of the polymer PTC component, the process comprising:

a resin supplying step of supplying a curable resin onto a support member extending outward from a periphery of at least one of the main surfaces of the polymer PTC component so as to cover the side surface of the polymer PTC component; and a step of curing the curable resin, wherein at least one of the layered metal electrodes has only a first part positioned on the main surface of polymer PTC component, and a peripheral part of the first part has a plastic film member on it or above it, the plastic film member comprises an inner portion positioned on or above the peripheral part of the layered metal electrode and a rim-like portion extending outward from an outer periphery of the inner portion, and the rim-like portion of the plastic film member functions as the support member.

8. The process for manufacturing according to claim 7, wherein the electrically conductive filler is a nickel or nickel alloy filler.

9. The process for manufacturing according to claim 7, wherein the resin disposed on the support member is a thermosetting resin.

10. The process for manufacturing according to claim 7, wherein both of the layered metal electrodes have only the first parts;

the peripheral part of each first part has the plastic film member on it or above it, each plastic film member comprises the inner portion positioned on or above the peripheral part of the layered metal electrode and the rim-like portion extending outward from the outer periphery of the inner portion;

the rim-like portion of each plastic film member functions as the support member; and the resin supplying step is performed by supplying the curable resin on at least one of the rim-like portions of the plastic film members so as to cover the side surface of the polymer PTC component with the curable resin positioned between the rim-like portions.

11. The process for manufacturing according to claim 7, comprising a step of disposing an adhesive layer on the peripheral part of the plastic film member, and disposing the plastic film member thereon.

12. The process for manufacturing according to claim 7, wherein the polymer PTC component has a flat disc shape.

* * * * *